US005970307A

United States Patent [19]

Hong et al.

[11] Patent Number: 5,970,307

[45] Date of Patent: Oct. 19, 1999

[54] SINTERING METHOD FOR TUNGSTEN-NICKEL-MANGANESE TYPE HEAVY ALLOY

[75] Inventors: Moon Hee Hong, Seoul; Woon Hyung Baek, Daejon; Joon Woong Noh, Daejon; Heung Sub Song, Daejon; Seong Lee, Daejon; Eun Pyo Kim, Daejon, all of Rep. of Korea

[73] Assignee: Agency for Defense Development, Daejon, Rep. of Korea

[21] Appl. No.: 08/841,717

[22] Filed: Apr. 30, 1997

[30] Foreign Application Priority Data

Apr. 30, 1996 [KR] Rep. of Korea ..... 96/13835

[51] Int. Cl.[6] ..... B22F 3/12

[52] U.S. Cl. ..... 419/54; 419/38; 419/47; 419/57; 419/58

[58] Field of Search ..... 419/38, 47, 57, 419/58, 54

[56] References Cited

U.S. PATENT DOCUMENTS

| | | | |
|---|---|---|---|
| 4,986,961 | 1/1991 | Spencer et al. | 419/36 |
| 5,145,512 | 9/1992 | Spencer et al. | 75/248 |
| 5,334,341 | 8/1994 | Streicher et al. | 419/53 |
| 5,338,506 | 8/1994 | Freiderichs et al. | 419/44 |
| 5,342,573 | 8/1994 | Amano et al. | 419/38 |
| 5,441,695 | 8/1995 | Gladden | 419/37 |

*Primary Examiner*—Daniel J. Jenkins

*Attorney, Agent, or Firm*—Nikaido, Marmelstein, Murray & Oram LLP

[57] ABSTRACT

A sintering method for a W—Ni—Mn type heavy alloy, including controlling the deoxidization of tungsten and nickel under an inert atmosphere, changing to a hydrogen atmosphere at above a temperature at which manganese is deoxidized and simultaneously deoxidizing tungsten, nickel and manganese, and sintering by raising the temperature, resulting in the fabrication of a sintered heavy alloy having a 100% relative theoretical density.

4 Claims, 5 Drawing Sheets

SINTERING METHOD FOR TUNGSTEN-NICKEL-MANGANESE TYPE HEAVY ALLOY

BACKGROUND OF THE INVENTION

1. Background of the Invention

The present invention relates to a sintering method for a tungsten-nickel-manganese (hereinafter, called "W—Ni—Mn") type heavy alloy, and in particular, to an improved sintering method for fabricating a W—Ni—Mn type heavy alloy which has no pores and a 100% theoretical density.

2. Description of the Conventional Art

A W—Ni—Mn type heavy alloy is composed of 90 weight % tungsten, and more than 0.5 weight % manganese and nickel.

The W—Ni—Mn type heavy alloy is composed of almost globular tungsten particles and a matrix phase of a W—Ni—Mn type heavy alloy into which a part of the tungsten is melted as shown in FIG. 1.

In a W—Ni—Mn type heavy alloy, an adiabatic shear band is maximized by adding manganese the thermal conductivity of which is low, instead of the iron(Fe) and copper(Cu) contained in a conventional W—Ni—Fe type and W—Ni—Cu type heavy alloys, and the heavy alloy can suitably be used as a material for a penetrant of a kinetic energy penetrator in the munitions field.( A Belhadjhamida and R. M. German, "The Effects of Atmosphere, Temperature, and Composition on the Densification and properties of W—Ni—Mn," compiled by J. M. Capus and R. M. German, VOL. 3, MPIF, Princeton, N.J., 1992, pp 47–55.)

A correlation between the penetrating force of a kinetic energy penetrator and an adiabatic shear band can be explained according to the schematic diagrams in FIGS. 2 and 3.(L. S. Magness and T. G. Farrand, "Deformation Behavior and its Relationship to the Penetration Performance of High Density Penetration Materials", Proc. 1990 Army Science Conf., Durham, N.C., May 1990, pp 149–164.) As shown in FIG. 2, when a penetrator of a material on which an adiabatic shear band does not occur collides with an object as shown in FIG. 2, it is easily transformed into a mushroom shape(,which is called "mushrooming") and the kinetic energy is dispersed across a relatively broad region. On the other hand, as shown in FIG. 3, when an adiabatic shear band occurs easily, the kinetic energy is concentrated into a narrow region. Since such a difference in energy concentration degree relates to the penetration force, the development of a penetrant material in which an adiabatic shear band occurs easily is of essential interest.

Factors which influence an adiabatic shear band are the specific heat, the strain hardening exponent, the thermal softening, the melting point and the thermal conductivity. The most important factor of all is known to be the thermal conductivity, since an adiabatic shear band is closely related to the heat transfer phenomenon.(A. Bose, H. Couque, J. Lankford, Jr., "Influence of Microstructure on Shear Localization in Tungsten Heavy Alloys," ed. by A. Bose and R. J. Dowding, Proc. Tungsten and Tungsten Alloys, MPIF, Princeton, N.J., 1992, pp 291–298.) Therefore, recently much attention has been focused on a W—Ni—Mn heavy alloy containing manganese the thermal conductivity of which is extremely low, and in which the adiabatic shear band occurs easily.

W—Ni—Mn type heavy alloys are fabricated by means of a powder metallurgy, as in W—Ni—Fe type and W—Ni—Cu type heavy alloys. Such a conventional sintering method as shown in FIG. 4 will now be described in detail.

As shown in FIG. 4, conventionally, W—Ni—Mn type heavy alloys are fabricated by a liquid phase sintering under a hydrogen atmosphere.

That is, the reason for keeping the heavy alloy at 800° C. for 60 minutes during the sintering process is for the purpose of deoxidizing the oxides of tungsten, nickel and manganese existing on the surface of the material powders of W—Ni—Mn type heavy alloys under a hydrogen atmosphere.

However, according to the thermodynamic data concerning oxidation/deoxidation of each element, while tungsten and nickel are easily deoxidized at the above temperature range, but manganese is not deoxidized, but rather the oxides are set in a more stable condition. This means that the oxygen separated in the deoxidation of tungsten and nickel reacts with the manganese, resulting in a formation of manganese oxide. Since this manganese oxide becomes stable thermodynamically and is not easily deoxidized, residual porosity is disadvantageously formed during the sintering, as in the fine microstructure as observed through a SEM shown in FIG. 5.

These residual pores lower the mechanical strength of W—Ni—Mn type heavy alloys and consequently limit their use as a penetration material for a kinetic energy penetrator.

Therefore, to utilize W—Ni—Mn type heavy alloys as a kinetic energy penetrator, the formation of pores should be minimized. Therefor, studies have been conducted using a VHF (vacuum hot press) method instead of a liquid phase sintering, and studies are being conducted to reduce porosity through such a process as HIP (hot isostatic pressing) or by a thermal mechanical treatment carried out after performing a liquid phase sintering. But, in spite of such efforts, the reality is that alloys of greater than 98% relative theoretical density have not been obtained and the VHP or HIP process performed after a liquid phase sintering are undesirably costly.

SUMMARY OF THE INVENTION

Accordingly, it is an object of the present invention to provide an improved sintering method for a W—Ni—Mn type heavy alloy which has a 100% relative theoretical density and no residual porosity.

To achieve the above object, there is provided a sintering method which includes controlling the deoxidation of tungsten and nickel by maintaining an inert atmosphere, simultaneously deoxidizing tungsten, nickel and manganese by changing to a hydrogen atmosphere at a temperature higher than that at which manganese is deoxidized, and performing a liquid phase sintering by raising the temperature.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 7A through 7C are photographs of the fine microstructure of a W—Ni—Mn heavy alloy produced according to the sintering method of the present invention as observed through a SEM, wherein FIGS. 7A and 7B are of cases where a W—Ni—Mn heavy alloy is sintered under a nitrogen atmosphere, and is deoxidized under a hydrogen atmosphere at an optimum temperature, and FIG. 7C is of a case where the sintering proceeds under a hydrogen atmosphere without change.

DETAILED DESCRIPTION OF THE PREFERRED EMBODIMENTS

The sintering method for a W—Ni—Mn heavy alloy according to the invention will now be described with reference to the accompanying drawings.

Figure 6:
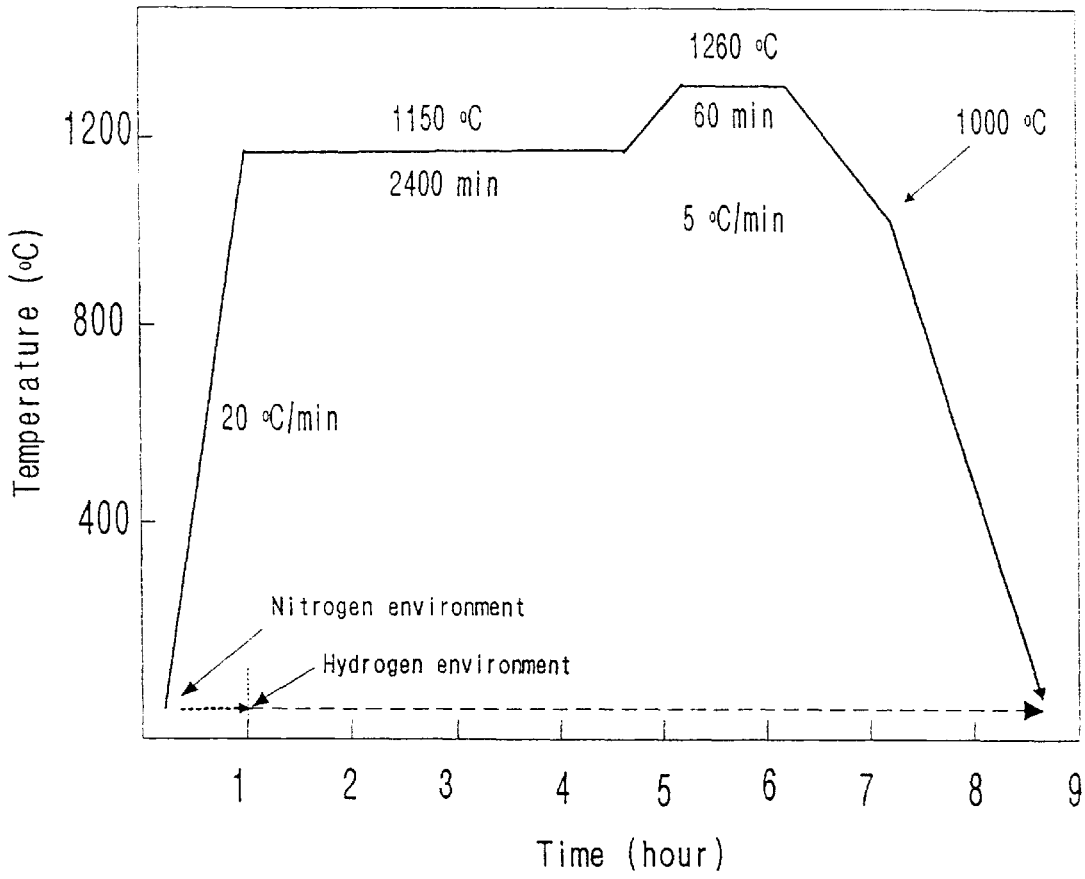
FIG. 6 is a process chart showing a sintering method for a W—Ni—Mn heavy alloy according to the present invention.

FIG. 6 is a process chart showing a sintering method for a W—Ni—Mn heavy alloy. As shown, after respective powders of more than 90 weight % tungsten, and more than 1 weight % manganese and nickel are mixed and compacted, the sintering environment in the conventional method is replaced with a deoxidative environment by raising the temperature of the thusly fabricated compact up to 1050° C.~1240° C. under an inert atmosphere (nitrogen, helium, argon) and the powders of tungsten, nickel and manganese are deoxidized simultaneously by maintaining the deoxidative atmosphere for 10 minutes to 24 hours. Finally, by raising the temperature up to 1250°~1450° C., a liquid phase sintering is performed on the powders, and then a furnace cooling is performed thereon.

In the course of the above-described process, the most preferred condition is that the powders are maintained for two to four hours at 1100°~1240° C. under an inert atmosphere, and are sintered for 30 minutes to two hours at 1270°~1400° C., and then are cooled in the furnace.

Figure 7A:
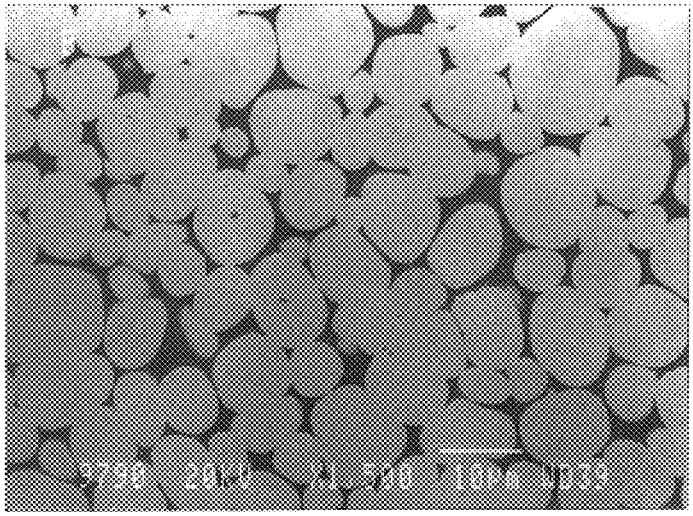
Figure 7B:
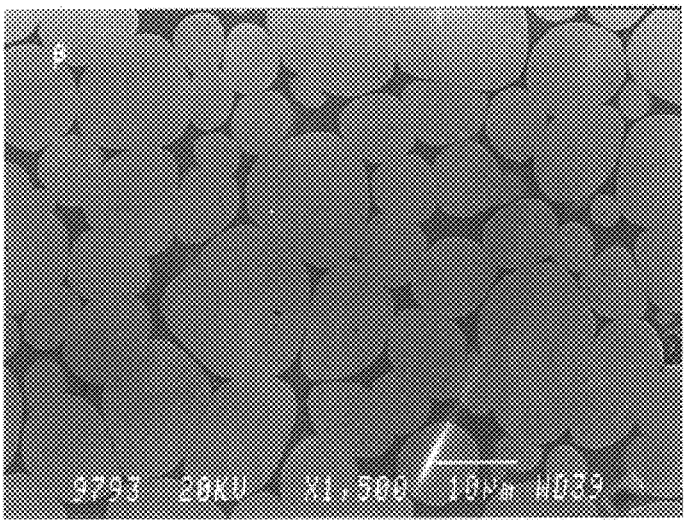

The thusly fabricated W—Ni—Mn heavy alloy has 100% relative theoretical density, and an almost poreless fine microstructure, as shown in FIGS. 7A and 7B.

Now, the change in the relative theoretical density in relation to the atmosphere gas and deoxidation temperature will be described in detail.

Powders of tungsten, nickel and manganese were measured to have a composition rate of 90 weight %, 6 weight % and 4 weight %, respectively and were mixed and compacted, resulting in a cylindrical compact having a 10 mm diameter and 20 mm thickness. The sintering method according to the present invention was performed, and the test pieces in Table 1 were obtained.

TABLE 1

| | | sintering condition | | | |
|---|---|---|---|---|---|
| | ntp | tea | de a | de t(° C.) | rtd(%) |
| con | 1 | hydrogen | hydrogen | 800 | 90 |
| pre | 2 | nitrogen | hydrogen | 1050 | 90 |

TABLE 1-continued

| | | sintering condition | | | |
|---|---|---|---|---|---|
| | ntp | tea | de a | de t(° C.) | rtd(%) |
| | 3 | nitrogen | hydrogen | 1100 | 98 |
| | 4 | nitrogen | hydrogen | 1150 | 100 |
| | 5 | nitrogen | hydrogen | 1200 | 100 |
| | 6 | nitrogen | hydrogen | 1240 | 100 |
| | 7 | hydrogen | hydrogen | 1150 | 90 |

Figure 1:
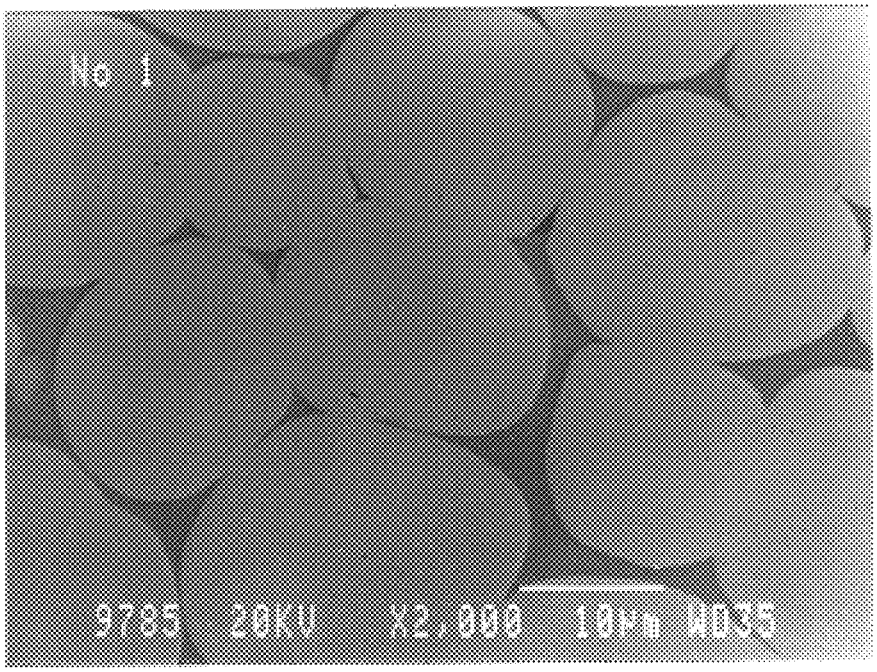
FIG. 1 is a photograph of the fine microstructure of a W—Ni—Mn heavy alloy according to a conventional art as observed through a SEM.
Figure 5:
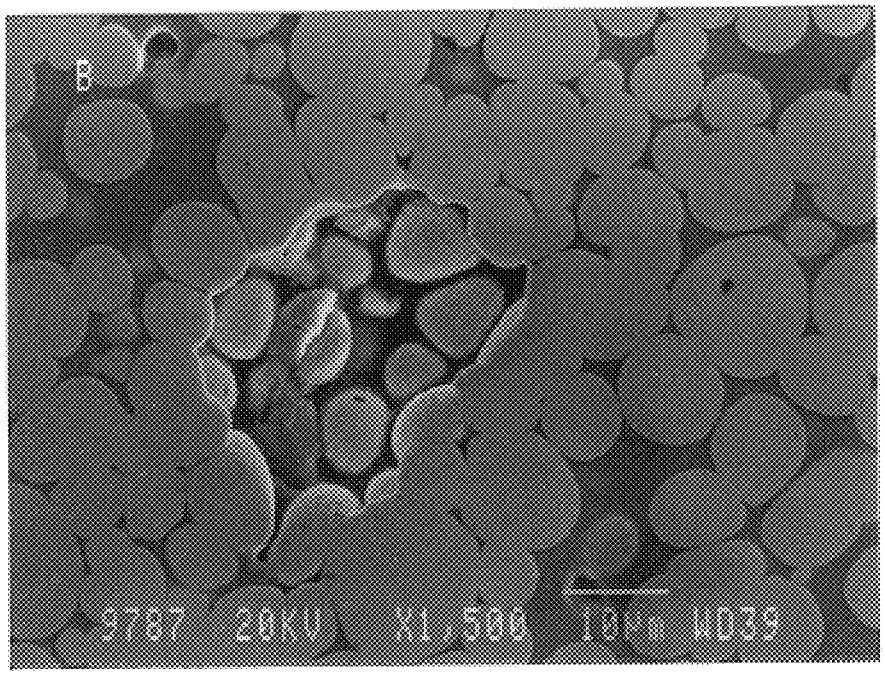
FIG. 5 is a photograph of the fine microstructure of a W—Ni—Mn heavy alloy fabricated according to a conventional sintering method as observed through a SEM.
Figure 2:
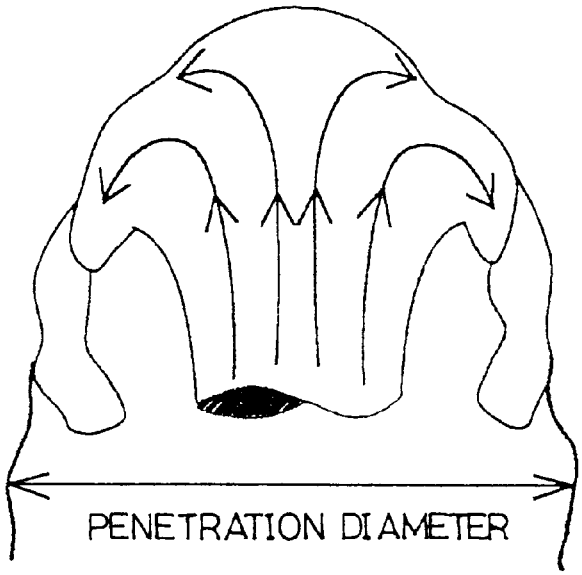
FIG. 2 CONVENTIONAL ART
FIG. 2 is a schematic diagram showing the high-speed transformation of a material in which an adiabatic shear band does not occur easily.
Figure 3:
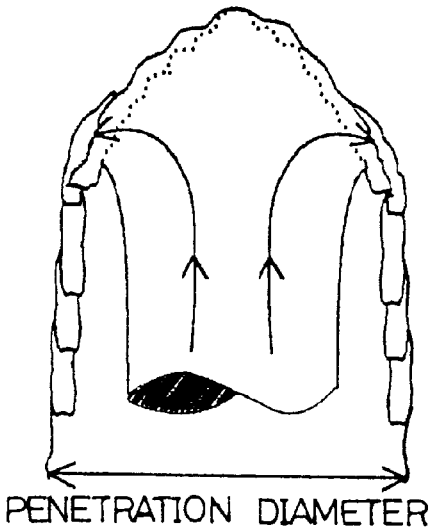
FIG. 3 CONVENTIONAL ART
FIG. 3 is a schematic diagram showing a high-speed transformation of a material in which an adiabatic shear band occurs easily.
Figure 4:
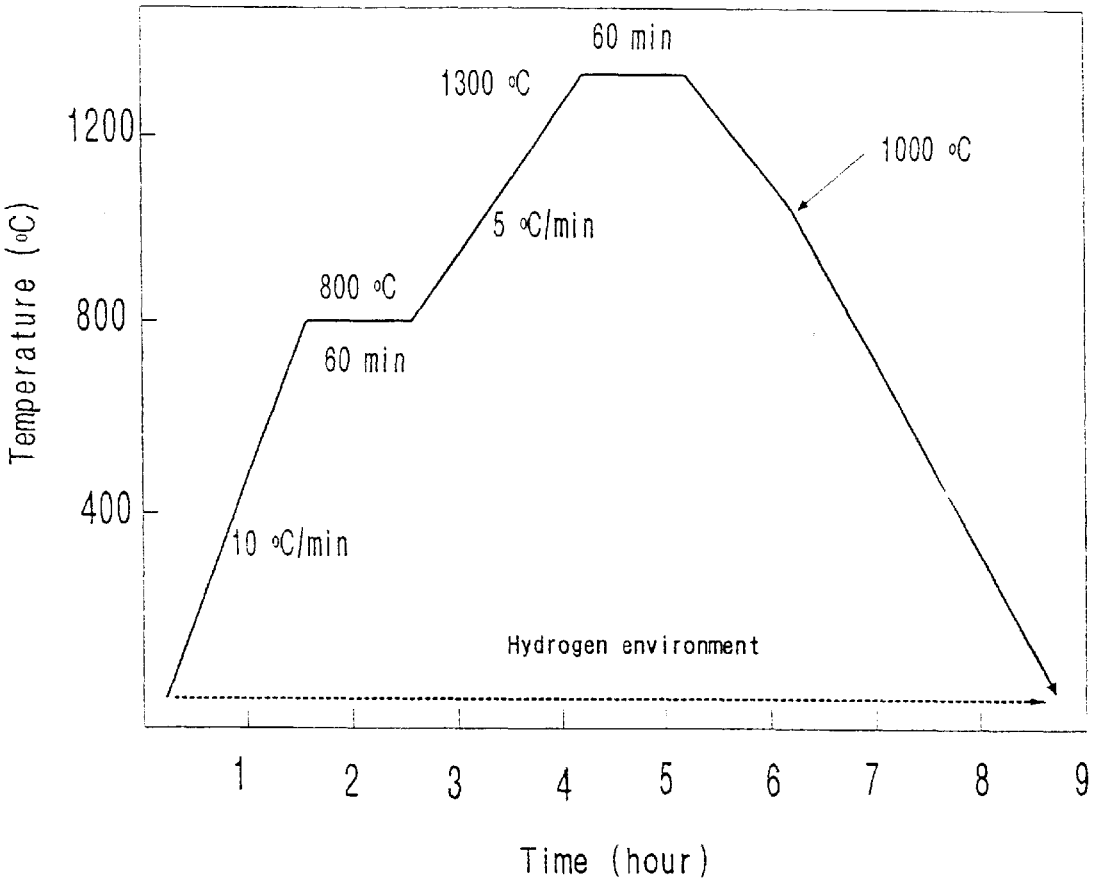
FIG. 4 CONVENTIONAL ART
FIG. 4 is a process chart showing a sintering method for a W—Ni—Mn heavy alloy according to the conventional art.

<note>
con: conventional art
pre: present invention
ntp: number of test pieces
tea: temperature elevation atmosphere
de a: deoxidation atmosphere
de t: deoxidation temperature
rtd: relative theoretical density The same sintering process as in FIG. 4 was performed, and by changing the deoxidation temperature as in Table 1, the deoxidation of the powders of tungsten, nickel and manganese was induced, resulting in the fabrication of the test pieces 2,3,4,5,6. In addition, by performing the same sintering process as in FIG. 6, while maintaining a hydrogen environment during the entire process, the test piece 7 was manufactured.

Table 1 shows the results of measuring the relative theoretical density of the test pieces obtained from the sintering under the above condition.

Here, the density was measured in accordance with the Archimedean method, and the average values of the test pieces were obtained from the results of more than 5 experiments performed under each conditions.

Figure 7C:
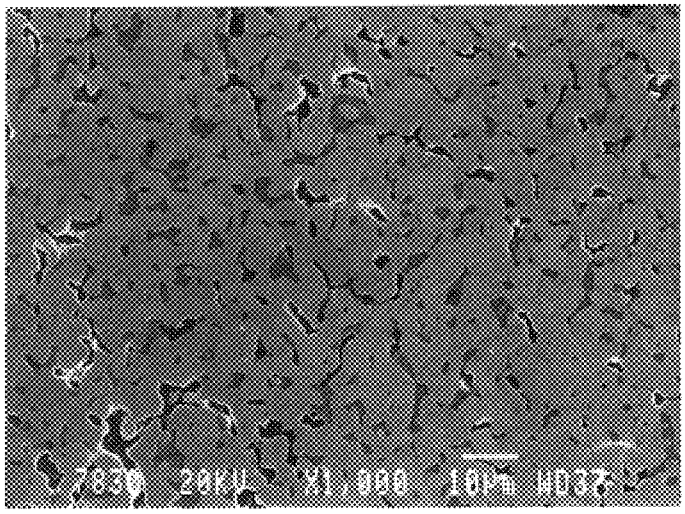

As shown in Table 1, compared with the test pieces obtained according to the conventional art, the test pieces obtained according to the present invention had an increased density, and what is better, a 100% relative theoretical density when a deoxidation temperature of over 1150° C. was employed. In addition, in the case that a hydrogen atmosphere was maintained throughout the entire processing (test piece 7), the test piece had a low sintering density. The reason is that when the atmosphere during temperature elevation is hydrogen, tungsten and nickel are deoxidized and simultaneously manganese is oxidized, but when the atmosphere during temperature elevation is nitrogen, the deoxidization of the tungsten and the nickel is controlled and as a result the manganese is not oxidized. The photographs of the fine microstructures of the test pieces obtained by the above-described sintering shows the influence of the atmospheres more clearly. FIGS. 7A through 7C are photographs of the fine microstructures of the test pieces 4,3 and 7, respectively. As shown in FIG. 7C, when the temperature is raised under a hydrogen atmosphere (test piece 7), the pores (white part) generated by non-deoxidized manganese can be observed, but when a nitrogen atmosphere is maintained during temperature elevation and then is changed to a hydrogen atmosphere at an appropriate temperature of deoxidization, as shown in FIGS. 7A through 7C, few pores can be observed(test pieces 3,4).

To determine the influence of the rate at which the temperature rises up to the deoxidization point, the same sintering as for test piece 4 in Table 1 was performed and by changing the rate of the temperature elevation up to 5° C. and 10° C. per minute, test pieces were fabricated and relative theoretical density was examined.

Next, to determined the influence of the maintenance time at the deoxidization temperature, the same sintering as for test piece 4 in Table 1 was performed and by changing the time of respectively maintenance to 30 minutes and one hour, test pieces were fabricated and relative theoretical density was examined.

TABLE 2

| | rte(° C./min) | | mt (hour) | |
|---|---|---|---|---|
| sc | 5 | 10 | 0.5 | 1 |
| ntp | 8 | 9 | 10 | 11 |
| rtd (%) | 100 | 100 | 95 | 98 |

As shown in table 2, although the rate of temperature elevation was changed from 5° C. to 10° C., the relative theoretical density remained unchanged at 100%. But, the maintenance time at the deoxidization temperature had a great effect on the relative theoretical density of the sintered test pieces. That is, comparing test piece 4 in Table 1 with test pieces 10 and 11 in Table 2, it is seen that the maintenance time at a deoxidization is increased, the relative theoretical density is accordingly increased. This means that a sufficient time should be maintained at a deoxidization temperature in order to fabricate a sintering body which has a 100% relative theoretical density.

Next, to determine the effect of the sintering method according to the present invention on heavy alloys which have different compositions, two heavy alloys of 90 wt % tungsten-4 wt % nickel-6 wt % manganese and 93 wt % tungsten-1.4 wt % nickel-5.6 wt % manganese were respectively mixed, compacted and sintered by the same method as for the test pieces in Table 1, and as a result, the values of the relative theoretical density were obtained as in Table 3.

TABLE 3

| | | | |
|---|---|---|---|
| ntp | 12 | 13 | 14 |
| com | 90W-4Ni-6Mn | 93W-1.4Ni-5.6Mn | 93W-2.1Ni-4.9Mn |
| rtp | 100 | 99.7 | 99.8 |

As shown in table 3, regardless of the composition of the W—Ni—Mn heavy alloys, a sintering body which has nearly 100% relative theoretical density is fabricated.

The sintering method according to the present invention is not limitative of the sintering of W—Ni—Mn type heavy alloys, and can be adopted to the sintering of heavy alloys containing an element such as chromium (Cr), examples of which are W—Ni—Mn, W—Ni—Cr, W—Ni—Fe—Cr and W—Ni—Mn—Cr type heavy alloys.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed:

1. A sintering method for a tungsten-nickel-manganese type heavy alloy, comprising:

heating a compacted mixture of powders of W,Ni and Mn at 1050~1240° C. under an inert atmosphere for controlling the deoxidzation of tungsten and nickel;

changing the inert atmosphere to a hydrogen atmosphere at above a temperature at which manganese is deoxidized and simultaneously deoxidizing tungsten, nickel and manganese; and performing a liquid phase sintering on the thusly deoxidized material.

2. The sintering method of claim 1, wherein gases used for the inert atmosphere are one or more of nitrogen($N_2$), argon(Ar) and helium(He).

3. The sintering method of claim 1, wherein the temperature at which the change to the hydrogen atmosphere occurs is 1050° C. to 1240° C. and the compacted mixture is maintained under the hydrogen atmosphere for 10 minutes to 24 hours.

4. The sintering method of claim 1, wherein the liquid phase sintering is performed at a temperature of 1250° C. to 1450° C. for 10 minutes to 24 hours.

* * * * *